US005960997A

United States Patent [19]

Forsythe

[11] Patent Number: 5,960,997

[45] Date of Patent: Oct. 5, 1999

[54] BEVERAGE DISPENSING APPARATUS

[75] Inventor: David P. Forsythe, Fenton, Mo.

[73] Assignee: Multiplex Company, Inc., Ballwin, Mo.

[21] Appl. No.: 08/909,555

[22] Filed: Aug. 12, 1997

[51] Int. Cl.[6] ..... B67D 5/56

[52] U.S. Cl. ..... 222/129.3; 222/641; 222/129.4

[58] Field of Search ..... 222/52, 63, 641, 222/129.1–129.4

[56] References Cited

U.S. PATENT DOCUMENTS

| | | | |
|---|---|---|---|
| 2,880,912 | 4/1959 | Fisher | 222/129.4 |
| 3,396,871 | 8/1968 | McCann | 222/76 |
| 3,640,433 | 2/1972 | Rodth | 222/129.2 |
| 3,643,688 | 2/1972 | Meinert | 137/556 |
| 4,011,967 | 3/1977 | Halsey et al. | 222/70 |
| 4,753,370 | 6/1988 | Rudick | 222/105 |
| 4,815,633 | 3/1989 | Kondo et al. | 222/129.4 |
| 4,821,925 | 4/1989 | Wiley et al. | 222/129.4 |
| 4,923,092 | 5/1990 | Kirschner et al. | 222/129.4 |
| 5,033,648 | 7/1991 | Nakayama et al. | 222/129.1 |
| 5,062,555 | 11/1991 | Whigham et al. | 222/641 |
| 5,303,846 | 4/1994 | Shannon | 222/54 |

*Primary Examiner*—Gregory L Huson

*Attorney, Agent, or Firm*—Senniger, Powers, Leavitt & Roedel

[57] ABSTRACT

A beverage dispensing apparatus comprises a system for dispensing a base beverage including a control for controlling dispensing of a quantity of the base beverage, and a system for dispensing at least one flavoring for admixture with the dispensed base beverage. The flavoring dispensing system has a valve for controlling dispensing of the flavoring and a control operable in response to actuation of the beverage dispensing system control to dispense base beverage for opening the valve to dispense flavoring simultaneously and throughout dispensing of the base beverage with a constant volume ratio of base beverage and flavoring.

13 Claims, 3 Drawing Sheets

BEVERAGE DISPENSING APPARATUS

BACKGROUND OF THE INVENTION

This invention relates generally to beverage dispensing apparatus, and more particularly to beverage dispensing apparatus for dispensing conventional beverages with added flavoring.

The apparatus of this invention is especially (albeit not exclusively) suited for dispensing flavored beverages (e.g. soft drinks). Soft drink beverages are typically dispensed from a conventional beverage dispenser in which a base beverage in the form of a concentrated syrup, such as a cola syrup, is dispensed along with a diluting agent, such as carbonated water, into a cup. The dispensing system includes a housing unit, a dispensing nozzle, fluid lines connecting the nozzle to the source of base beverage syrup and a source of diluting agent, a valve for controlling the dispensing of the base beverage and a switch, such as a lever or a keyboard, for controlling actuation of the valve.

Flavoring these standard base beverages with additional flavoring such as cherry or vanilla flavoring has become particularly popular. Presently, flavoring is added to the standard base beverage and packaged as a pre-mix flavored syrup before being hooked up to the fluid lines of the beverage dispenser for dispensing in a conventional manner. For example, beverages sold under the tradenames Cherry Coke and Vanilla Coke are produced by admixing cherry or vanilla flavoring with the base cola syrup to create a flavored cola syrup that can be dispensed from a standard beverage dispenser.

However, adding flavoring to the base beverage prior to dispensing can lead to non-uniform dispersion or layered stratification of the flavoring throughout the base beverage, resulting in a noticeable taste variance as the beverage is consumed. In addition, pre-mixing the flavoring requires additional processing equipment, thereby increasing the cost of the flavored beverage and the time required to create the flavored beverage.

It is also known to manually add flavoring to a base beverage after it has been dispensed into a cup. This method of beverage flavoring also results in increased time to create the beverage and layered stratification of the flavoring throughout the beverage. In addition, since various sizes of cups require correspondingly varying amounts of added flavoring, mixing of the flavoring after the base beverage is dispensed may not assure that the proper ratio of flavoring to base beverage is maintained from one cup size to another.

SUMMARY OF THE INVENTION

Among the several objects of this invention may be noted the provision of an improved beverage dispensing apparatus for dispensing flavoring into a cup for admixture with a base beverage; the provision of such apparatus which promotes uniform mixing of the flavoring with the base beverage; the provision of such apparatus which maintains a constant volume ratio of flavoring to base beverage regardless of the cup size being filled with beverage; and the provision of such an apparatus that permits the source of flavoring to be located remote from the apparatus.

In general, a beverage dispensing apparatus of the present invention comprises a system for dispensing a base beverage including a control for controlling dispensing of a quantity of the base beverage, and a system for dispensing at least one flavoring for admixture with the dispensed base beverage. The flavoring dispensing system has a valve for controlling dispensing of the flavoring and a control operable in response to actuation of the beverage dispensing system control to dispense base beverage for opening the valve to dispense flavoring simultaneously and throughout dispensing of the base beverage with a constant volume ratio of base beverage and flavoring.

Other objects and features will be in part apparent and in part pointed out hereinafter.

DETAILED DESCRIPTION OF THE DRAWINGS

Corresponding parts are designated by corresponding numerals throughout the several views of the drawings.

DETAILED DESCRIPTION OF THE PREFERRED EMBODIMENTS

Figure 1:
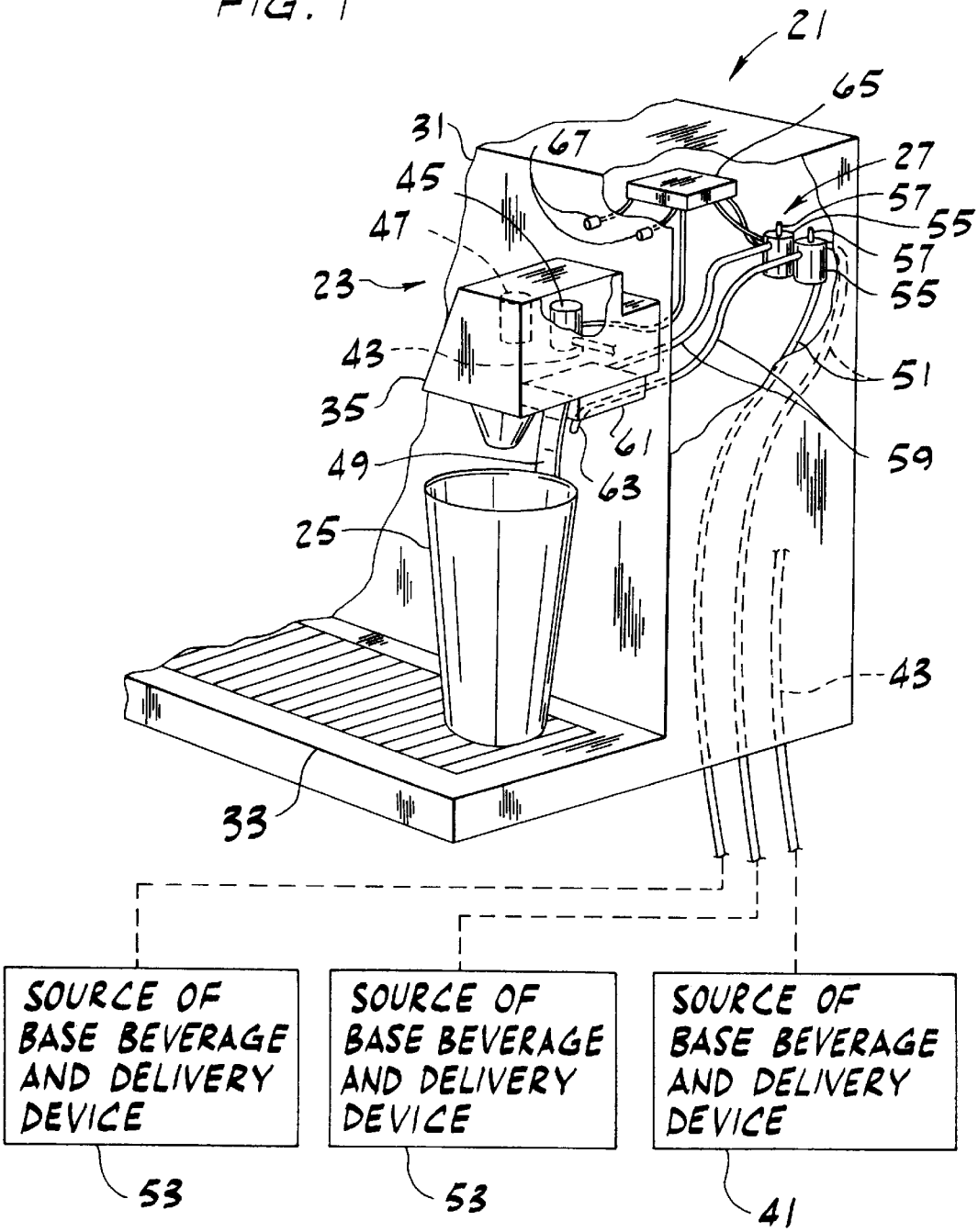
FIG. 1 is a schematic of a beverage dispensing apparatus of the present invention.

Now referring to the drawings, and more particularly to FIG. 1, beverage dispensing apparatus of the present invention is indicated in its entirety as 21. This dispensing apparatus 21 is particularly suited for dispensing flavored beverages in which flavoring is dispensed into a cup simultaneously with a standard base beverage for admixture with the base beverage. The base beverage may be a soft drink, such as those known under the tradenames COCA COLA, PEPSI, SEVEN-UP, or other type of commonly dispensed drink, without added flavoring. The dispensing apparatus 21 as shown comprises a base beverage dispensing system, indicated generally at 23, for dispensing the base beverage into a cup 25 or other type of container and a flavoring dispensing system, indicated generally at 27, for dispensing one or more flavorings into the cup for admixture with the dispensed base beverage.

The base beverage dispensing system 23 is operable between a dispensing mode in which base beverage is dispensed into the cup 25 and a non-dispensing mode. The system 23 comprises a main housing 31 and a drip tray 33 integrally formed with and extending forward from a lower portion of the main housing. A valve housing 35 projects forward from the main housing 31 and is spaced above the drip tray 33 to permit the cup 25 to be placed on the drip tray generally beneath the valve housing during dispensing of the base beverage. The valve housing 35 as shown is integrally formed with the main housing 31, but may also be constructed separate from the main housing and attached thereto by suitable connectors (not shown) and remain within the scope of this invention. A nozzle 37 is mounted on the underside of the valve housing 35 to provide an outlet through which the base beverage is dispensed into the cup 25. Tubing 43 extends within the valve housing 35 and main housing 31 generally from the nozzle 37 back to a source of base beverage syrup 41 remotely located from the main housing to define a beverage line through which the base beverage syrup flows. As illustrated diagrammatically in FIG. 1, the source of base beverage syrup 41 includes a delivery device, such as a pump (not shown), for effecting delivery of the base beverage through the beverage line 43. Additional tubing (not shown) delivers carbonated water or other diluting agent to the nozzle 37 for mixing with the base beverage in the nozzle and dispensing into the cup 25.

A solenoid valve 45 is disposed in the valve housing 35 and communicates with the beverage line 43 to function as a control for controlling the dispensing of base beverage. In the dispensing mode of the base beverage dispensing system 23, the valve 45 is open to permit dispensing of base beverage, and is closed in the non-dispensing mode to block flow through the beverage line 43 to the nozzle 37. A second solenoid valve 47 in the valve housing 35 controls the dispensing of the carbonated water. A switch for the base beverage dispensing system is defined by a lever 49 projecting down from the valve housing 35 rearward of the nozzle 37. The lever 49 is electrically connected by suitable wiring to the solenoid valve 45 and is capable of actuation, such as by pushing the cup 25 rearward against the lever, to a dispensing position in which a beverage control signal is generated and transmitted to the solenoid valve to cause the valve to open for dispensing base beverage. A suitable biasing spring (not shown) biases the lever 49 to a non-dispensing, unactuated position when the cup 25 is no longer pushing against the lever. The valve 47 controlling the dispensing of the carbonated water is also opened upon actuation of the lever 49. The lever 49 preferably extends down from the valve housing 35 a sufficient length to accommodate various cup sizes (e.g. cup heights corresponding to small, medium and large sized drink portions).

Still referring to FIG. 1, the flavoring dispensing system 27 comprises a pair of tubes 51 that define flavoring lines for delivering flavoring to the cup 25 from a respective source of flavoring 53 located remote from the main housing 31. The number of flavoring lines 51 may vary depending on the number of flavorings that may be added to a particular base beverage. For example, the flavoring lines 51 of the illustrated embodiment permit up to two flavorings to be dispensed along with the base beverage. However, for the purposes of further describing the flavoring dispensing system 27 of the present invention, reference will be made only to components sufficient to dispense a single flavoring, it being understood that other flavorings may be included in the flavoring dispensing system and dispensed in a similar manner.

The source of flavoring 53 includes a delivery device, such as a pump (not shown) or other suitable device, for effecting the delivery of flavoring from the source of flavoring through the flavoring line. It is also contemplated that the delivery device may be located in the main housing 31 and remain within the scope of the invention. A solenoid valve 55 is disposed in the main housing 31 in fluid communication with the flavoring line 51 to control dispensing of the flavoring. The valve 55 includes a conventional flow control device 57 for controlling the rate of flow through the valve when the valve is open. A portion 59 of the flavoring line 51 upstream of the valve 55 extends forward and outward through the main housing 31 and passes through a support block 61 mounted on the underside of the valve housing 35 rearward of the nozzle 37. The support block 61 supports the flavoring line 51 against sagging and protects the line against impact damage.

The flavoring line 51 passes generally longitudinally through the support block 61 and has an outlet 63 in close proximity of the nozzle 37 of the base beverage dispensing system 23. The outlet 63 of the flavoring line 51 is oriented slightly downward for directing flavoring dispensed from the flavoring line down into the cup 25 below the nozzle 37. As illustrated in FIG. 1, the flavoring line outlet 63 is angled with respect to the nozzle 37 such that the dispensed flavoring intersects the flow of base beverage dispensed from the nozzle of the base beverage dispensing system 23 to facilitate admixture of the flavoring and base beverage. It is to be understood that the support block 61 may be mounted on the main housing 31, disposed in the valve housing 35 or main housing, or may be omitted without departing from the scope of this invention, as long as the outlet 63 of the flavoring line 51 is oriented for dispensing the flavoring into the cup 25.

A control 65 for the flavoring dispensing system 27 is disposed in the main housing 31 and is electrically connected to the flavoring solenoid valve 55 for controlling operation of the valve. The control 65 is also electrically connected by suitable wiring to the beverage dispensing switch 49. Thus, the beverage control signal is transmitted to and received by both the base beverage solenoid 45 and the control 65 upon actuation of the lever 49 to dispense base beverage. A switch 67 (e.g. button) projects outward from the front of the main housing 31 and is capable of transmitting a flavoring control signal upon actuation of the switch, such as by pushing inward against the switch. The flavoring dispensing system switch 67 is electrically connected by suitable wiring to the flavoring dispensing system control 65 so that the flavoring control signal is transmitted to and received by the control. The switch 67 may also include a lighting device (not shown) for illuminating the switch when the switch is activated. In this embodiment, the flavoring dispensing system 27 only dispenses flavoring into the cup 25 in response to the control 65 receiving both the beverage control signal and the flavoring control signal.

Figure 3:
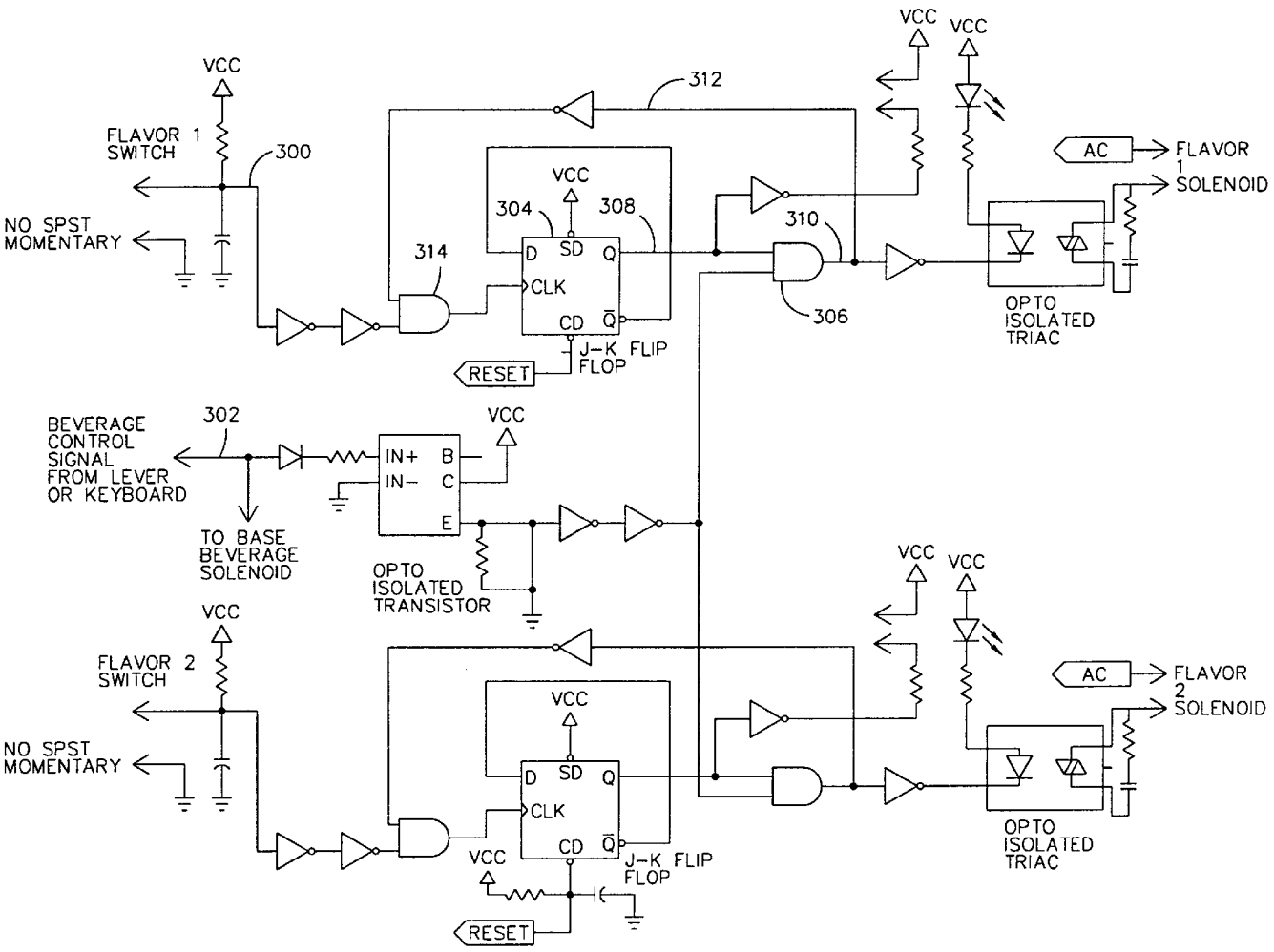
FIG. 3 is a schematic wiring diagram of the beverage dispensing apparatus of FIGS. 1 and 2.

With reference to FIG. 3, the flavoring dispensing system control 65 receives the flavoring control signal via line 300 when the operator depresses the flavoring dispensing switch 67 and receives the beverage control signal via line 302 when the operator actuates the lever 49 to dispense the base beverage. As described above, the beverage control signal is also transmitted to the base beverage solenoid valve 45 for causing the base beverage to be dispensed. If a flavoring is not desired, then the flavoring dispensing system control 65 remains inactive and base beverage is dispensed in a conventional manner. However, the control 65 is responsive to both the flavoring control signal and the beverage control signal for dispensing the flavoring for admixing with the base beverage.

As an example, the flavoring dispensing switch 67 is embodied by a normally open single pole, single throw switch which only provides a momentary contact when depressed by the operator. The control 65 includes a flip flop 304 (e.g., a J-K flip flop) which is clocked, in general, by the positive-going transitions of the flavoring control signal input via line 300. As shown in FIG. 3, the flip flop 304 has an output Q connected to a gate 306 via line 308. In response to the momentary actuation of the flavoring dispensing switch 67, a dispensing mode is initiated by the output Q being set high. In a preferred embodiment of the invention, the gate 306 performs an AND function on the flip flop output Q which is input via line 308 and the beverage control signal which is input via line 300. The output of gate 306 at line 310 constitutes a valve control signal for actuating the flavoring solenoid valve 55 to dispense flavoring concurrently with the base beverage. In turn, a line 312 provides feedback of the output of gate 306 at line 310 to an AND gate 314 which combines the valve control signal with the flavoring control signal for clocking flip flop 304. In this manner, the flavoring dispensing system control 65 resets flip flop 304, initiating a non-dispensing reset mode, when the beverage control signal is no longer present.

In other words, flip flop 304 is configured for operation in a dispensing mode upon receiving the flavoring control signal transmitted upon actuation of the flavoring dispensing system switch 67, and a non-dispensing reset mode in which the flavoring control signal is deactivated. In the dispensing mode, flip flop 304 is capable of generating and transmitting the valve control signal to the flavoring solenoid valve 55 upon receiving the beverage control signal to open the valve for dispensing flavoring simultaneously with the base beverage throughout the duration of the dispensing of base beverage.

FIG. 3 also illustrates circuitry similar to the above-described circuitry for providing a valve control signal to a second flavoring dispensing solenoid valve.

In operation, with the base beverage dispensing system 23 assembled in a conventional manner, the flavoring line 51 is connected to the source of flavoring 53 and the flow control 57 of the valve is adjusted to provide a predetermined rate of flow of flavoring through the valve in accordance with a desired concentration ratio of flavoring and base beverage. To dispense only base beverage (e.g. without added flavoring), the cup 25 is placed upright on the drip tray 33 beneath the nozzle 37 of the base beverage dispensing system 23 and pushed against the lever 49. Actuation of the lever 49 to its dispensing position generates the beverage control signal which is transmitted to and received by the solenoid valves 45, 47 in the beverage line 43 and the carbonated water line. Upon receiving the control signal, the valves 45, 47 are opened to permit base beverage and carbonated water to flow through the beverage line and out the nozzle 37 into the cup 25. When the cup 25 is filled to a desired level, it is moved away from the lever 49 and the lever is biased back to its original, non-dispensing position, deactivating the beverage control signal so that the valves 45, 47 close.

To dispense flavoring along with the base beverage, the flavor dispensing system switch 67 is actuated by pushing inward against the switch. The switch 67 is illuminated by the lighting device to indicate that the switch has been activated. Actuation of the switch 67 generates and transmits a flavoring control signal that is received by the flip flop 304 of the flavoring dispensing system control 65 to place the flip flop in its dispensing mode. The cup 25 is then placed on the drip tray 33 and pushed against the lever 49 as described above to transmit the beverage control signal to the valves 45, 47 for dispensing the base beverage. The beverage control signal is also transmitted to and received by the flip flop 304. Since the flip flop 304 is in its dispensing mode (having received the flavoring control signal), it generates and transmits the valve control signal to the valve 55 in the flavoring line 51.

Upon receiving the valve control signal, the flavoring solenoid valve 55 opens for dispensing flavoring from the flavoring line outlet 63 simultaneously with the dispensing of the base beverage. The flavoring dispensed from the flavoring line outlet 63 intersects the flow of the base beverage from the nozzle 37 as it flows into the cup 25 to facilitate admixture of the base beverage and flavoring before reaching the bottom or otherwise the drink level of the cup. The flavoring is dispensed throughout the duration of dispensing of the base beverage. Once the cup 25 is filled to a desired level, it is pulled away from the lever 49 to deactivate the beverage control signal. The solenoid valves 45, 47 in the valve housing 35 are closed and, because the flip flop 304 no longer receives the beverage control signal, the flip flop is placed in its non-dispensing reset mode wherein the valve control signal is deactivated and the flavoring solenoid valve 55 is closed. The flavoring control signal is also deactivated and the flavor selection switch 67 is unilluminated.

Figure 2:
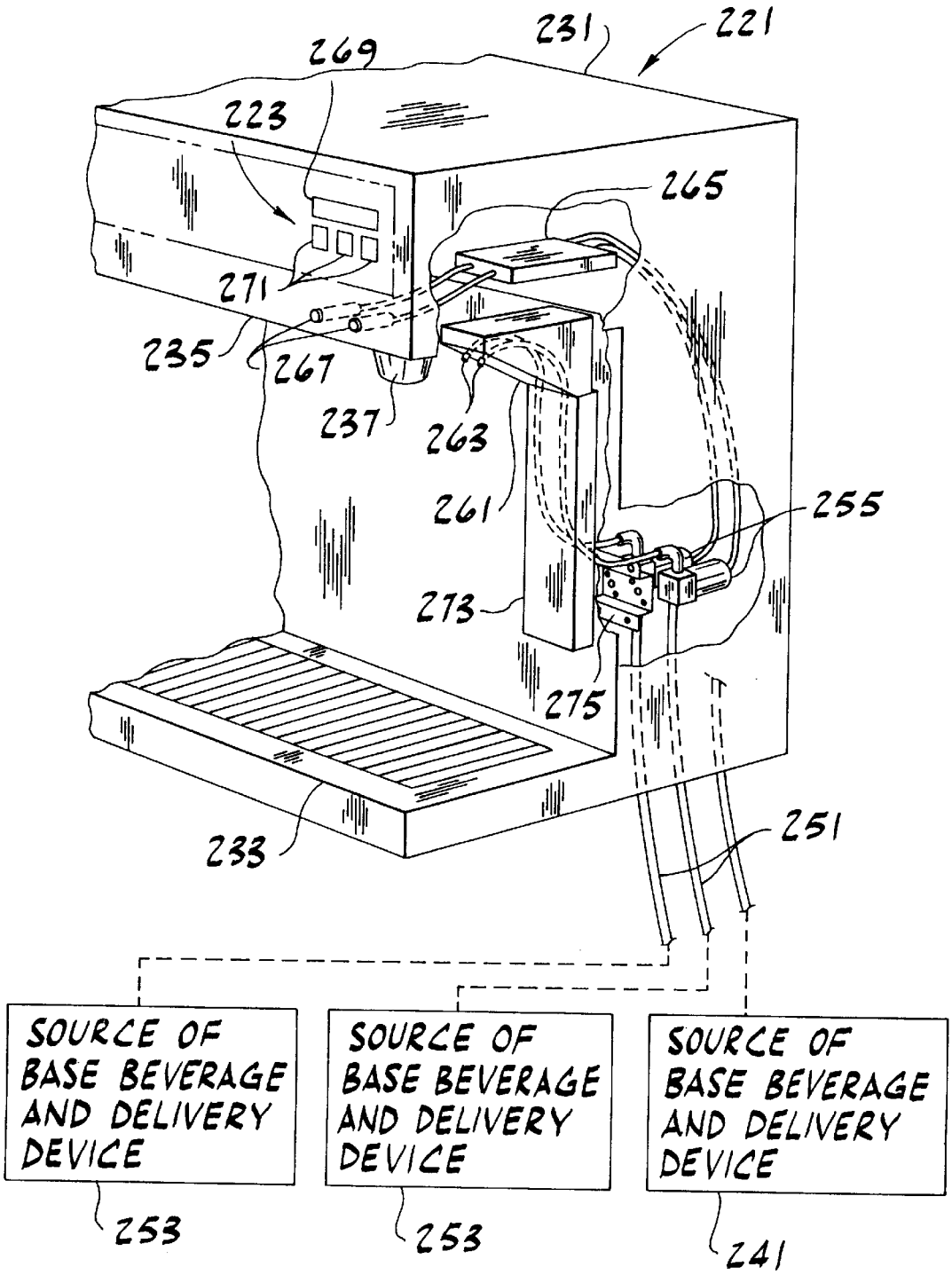
FIG. 2 is a schematic of a second embodiment of a beverage dispensing apparatus of the present invention.

FIG. 2 illustrates a second embodiment of the beverage dispensing apparatus 221 of the present invention in which the base beverage dispensing system switch is defined by a keyboard 269. The base beverage dispensing system 223 includes the main housing 231, drip tray 233, and valve housing 235 integrally formed with the main housing. The keyboard 269 is disposed on the front of the valve housing 235 and is electrically connected by suitable wiring to the base beverage solenoid valve (not shown in FIG. 2 but is substantially similar to the valve 45 of FIG. 1). Keys 271 of the keyboard 269 are capable of actuation, such as by pushing inward against the key, to a dispensing position in which a beverage control signal is generated and transmitted to the solenoid valve 45 to cause the valve to open for dispensing base beverage. The keyboard 269 may be connected to a timing device (not shown) so that the beverage control signal is deactivated after a predetermined period of time corresponding to the volume of base beverage to be dispensed (e.g. small, medium, large). The keyboard 269 may also be manually operable whereby the key 271 must be manually held in its dispensing position to generate the beverage dispensing control signal so that the control signal is transmitted only while the operator is depressing the key.

The flavoring line 251 of the flavoring dispensing system 227 of this second embodiment extends outward through the main housing 231 intermediate the drip tray 233 and valve housing 235 and extends upward, passing into and through a support block 261 mounted on the underside of the valve housing rearward of the nozzle 237. A cover 273 is secured to the main housing 231 over the flavoring line 251 and extends vertically between the support block 261 and the location at which the flavoring line extends outward of the main housing to protect the flavoring line against inadvertent contact by the operator. As shown in FIG. 2, the flavoring line 251 generally arches upward and forward through the support block 261 terminating in close proximity of the nozzle 237 of the base beverage dispensing system 223.

The outlet 263 of the flavoring line 251 is oriented slightly downward for directing flavoring dispensed from the flavoring line outlet down into the cup 225 below the nozzle 237. The orientation of the flavoring line outlet 263 is preferably such that the dispensed flavoring intersects the flow of base beverage dispensed from the nozzle 237 of the base beverage dispensing system 223 to facilitate admixture of the flavoring and base beverage. It is to be understood that the support block 261 may be mounted on the main housing 231, disposed in the valve housing 235 or main housing, or may be omitted without departing from the scope of this invention, as long as the flavoring line 251 is oriented for dispensing the flavoring into the cup 225. A mounting bracket 275 disposed in the main housing 231 supports the solenoid valve 255 in fluid communication with the flavoring line 251. The flavoring dispensing system control 265 and flavoring dispensing system switch 267 are constructed and arranged in a manner substantially similar to that of the first embodiment.

Operation of the dispensing apparatus 221 of the second embodiment is also similar to that described above with respect to the first embodiment and, in particular, with respect to FIG. 3. To dispense flavoring along with the base beverage, the flavoring dispensing system switch 267 is actuated by pushing inward against the switch. The switch 267 is illuminated by the lighting device to indicate that the flavor selection switch has been activated. Actuation of the switch 267 generates and transmits a flavoring control signal that is received by the flip flop 304 of the flavoring dispensing system control 265 to place the flip flop in its dispensing mode. The cup 225 is then placed on the drip tray 233 and a key 271 of the keyboard 269 (e.g. small, medium, large)

is depressed to generate and transmit the beverage control signal to the base beverage solenoid valve 45 for dispensing the base beverage. Depressing the key 271 also activates the timing device so that the beverage control signal will be deactivated after a predetermined time period corresponding to the selected drink size. The beverage control signal is also transmitted to and received by the flip flop 304. Since the flip flop 304 is in its dispensing mode (having received the flavoring control signal), the flip flop generates and transmits the valve control signal to the flavoring solenoid valve 255.

Upon receiving the valve control signal, the flavoring solenoid valve 255 opens for dispensing flavoring from the flavoring line outlet 263 simultaneously with the dispensing of the base beverage. The flavoring dispensed from the flavoring line outlet 263 intersects the flow of the base beverage from the nozzle 237 as it flows into the cup 225 to facilitate admixture of the base beverage and flavoring before reaching the bottom or otherwise the drink level of the cup. The flavoring is dispensed throughout the duration of dispensing of the base beverage. When the time period for dispensing the base beverage expires, the timing device deactivates the beverage control signal. The solenoid valve 45 in the valve housing 235 is closed and, because the flip flop 304 no longer receives the beverage control signal, the flip flop is placed in its non-dispensing reset mode in which the valve control signal is deactivated and the flavoring solenoid valve is closed. The flavoring control signal is also deactivated and the flavor selection switch 267 is reset and unilluminated.

It will be observed from the foregoing that the beverage dispensing apparatus shown and described herein satisfies the several various objectives of the invention and provides other advantageous results. Providing a flavoring dispensing system control 65 for controlling operation of the flavoring solenoid valve 55 in response to dispensing of the base beverage allows the flavoring to be dispensed into the cup 25 simultaneously and throughout dispensing of the base beverage. This results in a more uniform, thorough mixing of the flavor with the base beverage to provide a fresher, more consistent taste during consumption of the beverage. In addition, because the flavoring dispensing system control 65 is responsive only to the beverage control signal, a constant volume ratio of flavoring to base beverage is automatically maintained by the apparatus regardless of the size of the cup being filled.

In addition, since the flavoring is dispensed simultaneously with the base beverage, pre-mixing of the beverage is eliminated, thereby reducing the cost of additional processing equipment and the time required to create the flavored beverage. Also, the flavoring sources 53 can be located remote from the apparatus so that no additional counter space is needed to incorporate the flavoring dispensing system 27 with the base beverage dispensing system 21.

As various changes could be made in the above constructions without departing from the scope of the invention, it is intended that all matter contained in the above description or shown in the accompanying drawings shall be interpreted as illustrative and not in a limiting sense.

What is claimed is:

1. A beverage dispensing apparatus comprising:

a system for dispensing a base beverage, said base beverage dispensing system including a control for controlling dispensing of a quantity of the base beverage; and a system for dispensing at least one flavoring for admixture with the dispensed based beverage, said flavoring dispensing system having a valve for controlling dispensing of the flavoring and a control responsive to actuation of the beverage dispensing system control to dispense base beverage for opening the valve to dispense flavoring simultaneously and throughout dispensing of the base beverage with a constant volume ratio of base beverage and flavoring.

2. A beverage dispensing apparatus as set forth in claim 1 wherein the beverage dispensing system further includes a switch electrically connected with the beverage dispensing system control to provide a beverage control signal to the beverage dispensing system control to actuate the system between a dispensing mode and a non-dispensing mode, the flavoring dispensing system control being electrically connected to the beverage dispensing system switch for receiving the beverage control signal.

3. A beverage dispensing apparatus comprising:

a beverage dispensing system for dispensing a base beverage, said beverage dispensing system including a control for controlling dispensing of a quantity of the base beverage;

a flavoring dispensing system for dispensing at least one flavoring for admixture with the dispensed based beverage, said flavoring dispensing system having a valve for controlling dispensing of the flavoring and a control responsive to actuation of the beverage dispensing system control to dispense base beverage for opening the valve to dispense flavoring simultaneously and throughout dispensing of the base beverage with a constant volume ratio of base beverage and flavoring;

the beverage dispensing system further including a switch electrically connected with the beverage dispensing system control to provide a beverage control signal to the beverage dispensing system control to actuate the system between a dispensing mode and a non-dispensing mode, the flavoring dispensing system control being electrically connected to the beverage dispensing system switch for receiving the beverage control signal; and a flavoring dispensing system switch electrically connected to the flavoring dispensing system control for providing a flavoring control signal to the flavoring dispensing system control when the switch is activated, the flavoring dispensing system control receiving and responding to both the beverage control signal and the flavoring control signal for opening the valve of the flavoring dispensing system to dispense flavoring into the cup simultaneously and throughout dispensing of the base beverage.

4. A beverage dispensing apparatus as set forth in claim 3 wherein the flavoring dispensing system control has a flip flop for receiving and responding to the beverage control signal and the flavoring control signal, the flip flop being in a dispensing mode upon receiving the flavoring control signal whereby the flavoring dispensing system control is capable of opening the valve of the flavoring dispensing system in response to the flip flop receiving the beverage control signal upon and throughout dispensing of the base beverage, the flip flop being in a non-dispensing reset mode when it no longer receives the beverage control signal whereby the flavoring dispensing system control closes the valve to prevent dispensing of the flavoring and deactivates the flavoring control signal.

5. A beverage dispensing apparatus as set forth in claim 3 wherein the valve of the flavoring dispensing system is electrically connected to the flavoring dispensing system control, the flavoring dispensing system control transmitting a valve control signal to the valve in response to receiving the beverage control signal and the flavoring control signal for opening the valve.

6. A beverage dispensing apparatus as set forth in claim 5 wherein the flavoring dispensing system is connected to a source of flavoring remotely located from the apparatus.

7. A beverage dispensing apparatus as set forth in claim 3 wherein the beverage dispensing system has a beverage line through which base beverage flows, the beverage line having an outlet positioned for dispensing the base beverage into a cup, the flavoring dispensing system having a flavoring line through which flavoring flows, the flavoring line having an outlet positioned for dispensing the flavoring into the cup, the beverage line outlet and the flavoring line outlet being arranged with respect to each other so that flavoring dispensed through the flavoring line outlet mixes with base beverage dispensed from the beverage line outlet generally within the cup.

8. A beverage dispensing apparatus as set forth in claim 7 wherein the flavoring line outlet is arranged with respect to the beverage line outlet so that the flow of flavoring from the flavoring line outlet intersects the flow of base beverage from the beverage line outlet for admixture as the flavoring and base beverage are dispensed into the cup.

9. A beverage dispensing apparatus comprising:

a beverage dispensing system for dispensing a base beverage, said beverage dispensing system including a control for controlling dispensing of a quantity of the base beverage;

a flavoring dispensing system for dispensing at least one flavoring for admixture with the dispensed based beverage, said flavoring dispensing system having a valve for controlling dispensing of the flavoring and a control operable in response to actuation of the beverage dispensing system control to dispense base beverage for opening the valve to dispense flavoring simultaneously and throughout dispensing of the base beverage with a constant volume ratio of base beverage and flavoring; and a flavoring dispensing system switch electrically connected to the flavoring dispensing system control for providing a flavoring control signal to the flavoring dispensing system control when the switch is activated, the flavoring dispensing system control responding to both actuation of the beverage dispensing system control and the flavoring control signal for opening the valve of the flavoring dispensing system to dispense flavoring into the cup simultaneously and throughout dispensing of the base beverage.

10. A beverage dispensing apparatus as set forth in claim 9 wherein the valve of the flavoring dispensing system is electrically connected to the flavoring dispensing system control, the flavoring dispensing system control transmitting a valve control signal to the valve in response to receiving the beverage control signal and the flavoring control signal for opening the valve.

11. A beverage dispensing apparatus as set forth in claim 10 wherein the flavoring dispensing system is connected to a source of flavoring remotely located from the apparatus.

12. A beverage dispensing apparatus as set forth in claim 9 wherein the beverage dispensing system has a beverage line through which base beverage flows, the beverage line having an outlet positioned for dispensing the base beverage into a cup, the flavoring dispensing system having a flavoring line through which flavoring flows, the flavoring line having an outlet positioned for dispensing the flavoring into the cup, the beverage line outlet and the flavoring line outlet being arranged with respect to each other so that flavoring dispensed from the flavoring line outlet mixes with base beverage dispensed from the beverage line outlet generally within the cup.

13. A beverage dispensing apparatus as set forth in claim 12 wherein the flavoring line outlet is arranged with respect to the beverage line outlet so that the flow of flavoring from the flavoring line outlet intersects the flow of base beverage from the beverage line outlet for admixture as the flavoring and base beverage are dispensed into the cup.

* * * * *

UNITED STATES PATENT AND TRADEMARK OFFICE

CERTIFICATE OF CORRECTION

PATENT NO : 5,960,997

DATED : October 5, 1999

INVENTOR(S): David P. Forsythe

It is certified that error appears in the above-identified patent and that said Letters Patent is hereby corrected as shown below:

Drawing Sheet 1 of 3, Fig. 1, reference numeral 53 (both occurrences), "SOURCE OF BASE BEVERAGE AND DELIVERY DEVICE" should read--SOURCE OF FLAVORING AND DELIVERY DEVICE--.

Drawing Sheet 2 of 3, Fig. 2, reference numeral 253 (both occurrences), "SOURCE OF BASE BEVERAGE AND DELIVERY DEVICE" should read--SOURCE OF FLAVORING AND DELIVERY DEVICE--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*